US007797162B2

(12) United States Patent
Yoshida et al.

(10) Patent No.: US 7,797,162 B2
(45) Date of Patent: Sep. 14, 2010

(54) AUDIO ENCODING DEVICE AND AUDIO ENCODING METHOD

(75) Inventors: Koji Yoshida, Kanagawa (JP); Michiyo Goto, Tokyo (JP)

(73) Assignee: Panasonic Corporation, Osaka (JP)

( * ) Notice: Subject to any disclaimer, the term of this patent is extended or adjusted under 35 U.S.C. 154(b) by 735 days.

(21) Appl. No.: 11/722,821

(22) PCT Filed: Dec. 26, 2005

(86) PCT No.: PCT/JP2005/023809

§ 371 (c)(1),
(2), (4) Date: Jun. 26, 2007

(87) PCT Pub. No.: WO2006/070757

PCT Pub. Date: Jul. 6, 2006

(65) Prior Publication Data

US 2008/0091419 A1 Apr. 17, 2008

(30) Foreign Application Priority Data

Dec. 28, 2004 (JP) ..... 2004-380980
May 30, 2005 (JP) ..... 2005-157808

(51) Int. Cl.
*G10L 19/00* (2006.01)

(52) U.S. Cl. ..... 704/500; 704/501; 704/502; 381/23

(58) Field of Classification Search ..... 704/500, 704/502, 503, 504, 203, 216; 381/23, 17
See application file for complete search history.

(56) References Cited

U.S. PATENT DOCUMENTS 6,629,078 B1 9/2003 Grill et al.
7,181,019 B2 * 2/2007 Breebaart et al. ..... 381/23
2004/0109471 A1 6/2004 Minde et al.

(Continued)

FOREIGN PATENT DOCUMENTS

JP 4-324727 11/1992

(Continued)

OTHER PUBLICATIONS

Fuchs, "Improving Joint Stereo Audio Coding by Adaptive Inter-Channel Prediction," IEEE Workshop on Applications of Signal Processing to Audio and Acoustics, Oct. 17, 1993, pp. 39-42, XP000570718.

(Continued)

*Primary Examiner*—Huyen X. Vo
(74) *Attorney, Agent, or Firm*—Greenblum & Bernstein, P.L.C.

(57) ABSTRACT

There is provided an audio encoding device capable of generating an appropriate monaural signal from a stereo signal while suppressing the lowering of encoding efficiency of the monaural signal. In a monaural signal generation unit (101) of this device, an inter-channel prediction/analysis unit (201) obtains a prediction parameter based on a delay difference and an amplitude ratio between a first channel audio signal and a second channel audio signal; an intermediate prediction parameter generation unit (202) obtains an intermediate parameter of the prediction parameter (called intermediate prediction parameter) so that the monaural signal generated finally is an intermediate signal of the first channel audio signal and the second channel audio signal; and a monaural signal calculation unit (203) calculates a monaural signal by using the intermediate prediction parameter.

8 Claims, 11 Drawing Sheets

U.S. PATENT DOCUMENTS

2006/0178870 A1 8/2006 Breebaart et al.

FOREIGN PATENT DOCUMENTS

| | | |
|---|---|---|
| JP | 2004-325633 | 11/2004 |
| WO | 02/23528 | 3/2002 |
| WO | 03/090208 | 10/2003 |
| WO | 2004/084185 | 9/2004 |

OTHER PUBLICATIONS

Bisnas et al., "Stability of the Synthesis Filter in Stereo Linear Prediction", Proceedings of Pro Risc, pp. 230-237, XP002410750, Jan. 1, 2004.

Liebchen, "Lossless Audio Coding Using Adaptive Multichannel Prediction", Proceedings AES 113TH Convention, [Online], Oct. 5, 2002, XP002466533, Los Angeles, CA, Retrieved from the Internet: URL:http://www.nue.tu-berlin.de/publications/papers/aes113.pdf, retrieved on Jan. 29, 2008.

Extended European Search Report dated Nov. 25, 2009 that issued with respect to patent family member European Patent Application No. 09173155.4.

ISO/IEC 14496-3, "Information Technology-Coding of Audio-Visual Objects-Part 3: Audio," pp. 304-305 (Section 4.B.14: Scalable AAC with core coder), Dec. 2001.

* cited by examiner

AUDIO ENCODING DEVICE AND AUDIO ENCODING METHOD

TECHNICAL FIELD

The present invention relates to a speech coding apparatus and a speech coding method. More particularly, the present invention relates to a speech coding apparatus and a speech coding method that generate and encode a monaural signal from a stereo speech input signal.

BACKGROUND ART

As broadband transmission in mobile communication and IP communication has become the norm and services in such communications have diversified, high sound quality of and higher-fidelity speech communication is demanded. For example, from now on, hands free speech communication in a video telephone service, speech communication in video conferencing, multi-point speech communication where a number of callers hold a conversation simultaneously at a number of different locations and speech communication capable of transmitting the sound environment of the surroundings without losing high-fidelity will be expected to be demanded. In this case, it is preferred to implement speech communication by stereo speech which has higher-fidelity than using a monaural signal, is capable of recognizing positions where a number of callers are talking. To implement speech communication using a stereo signal, stereo speech encoding is essential.

Further, to implement traffic control and multicast communication in speech data communication over an IP network, speech encoding employing a scalable configuration is preferred. A scalable configuration includes a configuration capable of decoding speech data even from partial coded data at the receiving side.

As a result, even when encoding and transmitting stereo speech, it is preferable to implement encoding employing a monaural-stereo scalable configuration where it is possible to select decoding a stereo signal and decoding a monaural signal using part of coded data at the receiving side.

A monaural signal is generated from a stereo input signal in speech coding employing a monaural-stereo scalable configuration. For example, a method for generating monaural signals, includes averaging both channel (referred to as "ch" later) signals of a stereo signal and obtaining a monaural signal (see Non-Patent Document 1).

Non-patent document 1:

ISO/IEC 14496-3, "Information Technology-Coding of audio-visual objects-Part 3: Audio", subpart-4, 4.B.14 Scalable AAC with core coder, pp. 304-305, December 2001.

DISCLOSURE OF INVENTION

Problems to be Solved by the Invention

However, if a monaural is generated by simply averaging the signals of both channels of a stereo signal, particularly in a case where such a stereo signal is a speech signal, the monaural signal would be distorted with respect to the inputted stereo signal or have a waveform shape that is significantly different from that of the input stereo signal. This means that a signal that has deteriorated from the inputted signal originally intended for transmission or a signal that is different from the inputted signal originally intended for transmission is transmitted. Further, when a monaural signal that is distorted with respect to the input stereo signal or a monaural signal having a significantly different waveform shape from the input stereo signal is encoded using an coding model such as CELP coding that operates adequately in accordance with characteristics that are unique to speech signals, a signal of different characteristics than characteristics unique to speech signals are subjected to coding, and as a result coding efficiency decreases.

Therefore, it is an object of the present invention to provide a speech coding apparatus and a speech coding method capable of generating an appropriate monaural signal from a stereo signal and suppressing a decrease in coding efficiency of a monaural signal.

Means for Solving the Problem

A speech coding apparatus of the present invention employs a configuration including a first generating section that takes a stereo signal including a first channel signal and a second channel signal as an input signal and generates a monaural signal from the first channel signal and the second channel signal based on a time difference between the first channel signal and the second channel signal and an amplitude ratio of the first channel signal and the second channel signal; and an coding section that encodes the monaural signal.

Advantageous Effect of the Invention

According to the present invention, it is possible to generate an appropriate monaural signal from a stereo signal and suppress a decrease of the coding efficiency of a monaural signal.

BEST MODE FOR CARRYING OUT THE INVENTION

Embodiments of the present invention will be described in detail with reference to the appended drawings. In the following description, operation based on frame units will be described.

Embodiment 1

Figure 1:
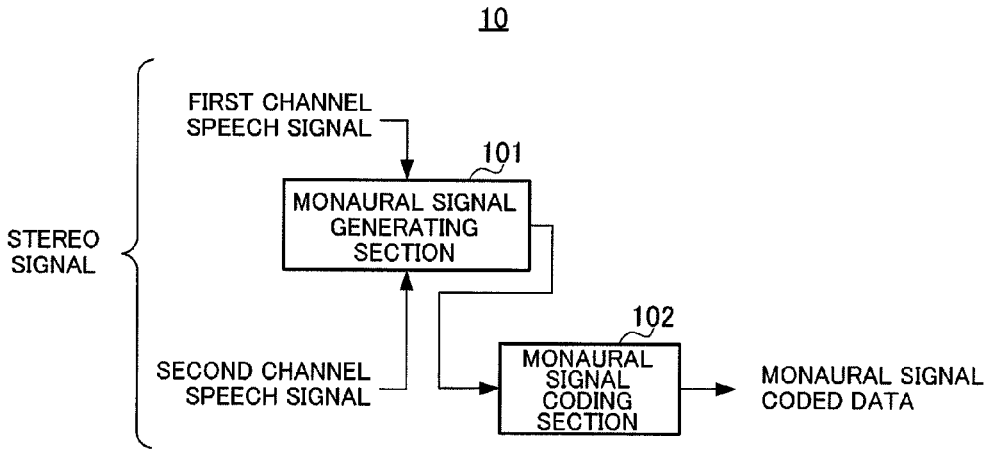
FIG. 1 is a block diagram showing a configuration of a speech coding apparatus according to Embodiment 1 of the present invention.

A configuration of a speech coding apparatus according to the present embodiment is shown in FIG. 1. Speech coding apparatus 10 shown in FIG. 1 has monaural signal generating section 101 and monaural signal coding section 102.

Monaural signal generating section 101 generates a monaural signal from a stereo input speech signal (a first channel speech signal, a second channel speech signal) and outputs the monaural signal to monaural signal coding section 102. Monaural signal generating section 101 will be described in detail later.

Monaural signal coding section 102 encodes the monaural signal, and outputs monaural signal coded data that is speech coded data for the monaural signal. Monaural signal coding section 102 can encode monaural signals using an arbitrary coding scheme. For example, monaural signal coding section 102 can use an coding scheme based on CELP coding appropriate for efficient speech signal coding. Further, it is also possible to use other speech coding schemes or audio coding schemes typified by AAC (Advanced Audio Coding).

Figure 2:
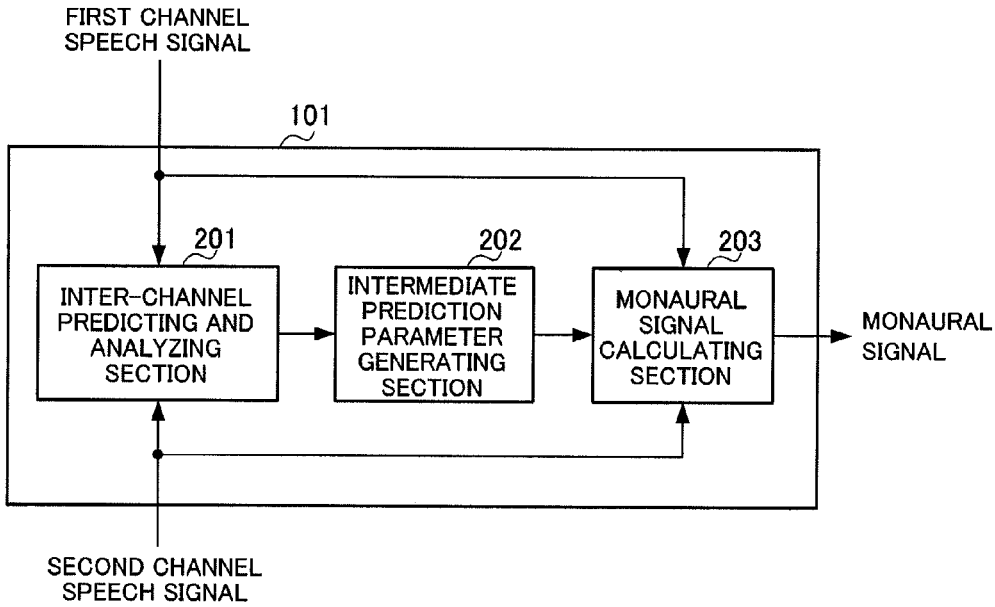
FIG. 2 is a block diagram showing a configuration of a monaural signal generating section according to Embodiment 1 of the present invention.

Next, monaural signal generating section 101 will be described in detail with reference to FIG. 2. As shown in FIG. 2, monaural signal generating section 101 has inter-channel predicting and analyzing section 201, intermediate prediction parameter generating section 202 and monaural signal calculating section 203.

Inter-channel predicting and analyzing section 201 analyzes and obtains prediction parameters between channels from the first channel speech signal and the second channel speech signal. The prediction parameters enable prediction between channel signals by utilizing correlation between the first channel speech signal and the second channel speech signal and are based on delay differences and amplitude ratio between both channels. To be more specific, when a first channel speech signal sp_ch1($n$) predicted from a second channel speech signal s_ch2($n$) and the second channel speech signal sp_ch2($n$) predicted from the first channel speech signal s_ch1($n$) are represented by equation 1 and equation 2, delay differences $D_{12}$ and $D_{21}$, and amplitude ratio (average amplitude ratio in frame units) $g_{12}$ and $g_{21}$ between channels are taken as prediction parameters.

[1]

$$sp_ch1(n)=g_{21}\cdot s_ch2(n-D_{21}) \text{ where } n=0 \text{ to } NF\text{-}1 \quad \text{(Equation 1)}$$

$$sp_ch2(n)=g_{12}\cdot s_ch1(n-D_{12}) \text{ where } n=0 \text{ to } NF\text{-}1 \quad \text{(Equation 2)}$$

Here, sp_ch1($n$) represents a first channel prediction signal, $g_{21}$ represents amplitude ratio of a first channel input signal with respect to a second input signal, s_ch2($n$) represents a second channel input signal, $D_{21}$ represents the delay time difference of a first channel input signal with respect to a second channel input signal, sp_ch2($n$) represents a second channel prediction signal, $g_{12}$ represents amplitude ratio of a second channel input signal with respect to a first channel input signal, s_ch1($n$) represents a first channel input signal, $D_{12}$ represents the delay time difference of a second channel input signal with respect to a first channel input signal and NF represents frame length.

Inter-channel predicting and analyzing section 201 obtains distortions represented by equations 3 and 4, that is, prediction parameters $g_{21}$, $D_{21}$, $g_{12}$ and, $D_{12}$ which minimize distortions Dist1 and Dist2 between input speech signals s_ch1($n$) and s_ch2($n$) (where n=0 to NF-1) of each channel and prediction signals sp_ch1($n$) and sp_ch2($n$) of each channel predicted in accordance with and equations 1 and 2, and outputs the distortions to intermediate prediction parameter generating section 202.

[2]

$$Dist1 = \sum_{n=0}^{NF-1} \{s_ch1(n) - sp_ch1(n)\}^2 \quad \text{(Equation 3)}$$

$$Dist2 = \sum_{n=0}^{NF-1} \{s_ch2(n) - sp_ch2(n)\}^2 \quad \text{(Equation 4)}$$

Inter-channel predicting and analyzing section 201 may obtain the delay time difference that maximizes cross-correlation between channel signals, or obtain an average amplitude ratio between channel signals in frame units as prediction parameters rather than obtaining prediction parameters that minimize distortions Dist1 and Dist2.

To obtain the actually generated monaural signal as an intermediate signal of the first channel speech signal and the second channel speech signal, intermediate prediction parameter generating section 202 obtains intermediate parameters (hereinafter referred to as "intermediate prediction parameters") $D_{1m}$, $D_{2m}$, $g_{1m}$ and $g_{2m}$ for prediction parameters $D_{12}$, $D_{21}$, $g_{12}$ and $g_{21}$ using equations 5 to 8, and outputs the monaural signal to monaural signal calculating section 203.

[3]

$$D_{1m}=D_{12}/2 \quad \text{(Equation 5)}$$

$$D_{2m}=D_{21}/2 \quad \text{(Equation 6)}$$

$$g_{1m}=\sqrt{g_{12}} \quad \text{(Equation 7)}$$

$$g_{2m}=\sqrt{g_{21}} \quad \text{(Equation 8)}$$

Here, $D_{1m}$ and $g_{1m}$ represent intermediate prediction parameters (the delay time difference, amplitude ratio) based on the first channel as a reference, $D_{2m}$ and $g_{2m}$ represent intermediate prediction parameters (the delay time difference, amplitude ratio) based on the second channel as a reference.

Intermediate prediction parameters may be obtained only from delay time difference $D_{12}$ and amplitude ratio $g_{12}$ for the second channel speech signal with respect to the first channel speech signal using equations 9 to 12 rather than using equations 5 to 8. Conversely, intermediate prediction parameters may be obtained in the same manner only from the delay time difference $D_{21}$ and amplitude ratio $g_{21}$ for the first channel speech signal with respect to the second channel speech signal.

[4]

$$D_{1m}=D_{12}/2 \quad \text{(Equation 9)}$$

$$D_{2m}=D_{1m}-D_{12} \quad \text{(Equation 10)}$$

$$g_{1m}=\sqrt{g_{12}} \quad \text{(Equation 11)}$$

$$g_{2m}=1/g_{1m} \quad \text{(Equation 12)}$$

Further, amplitude ratios $g_{1m}$ and $g_{2m}$ may also be fixed values (for example, 1.0) rather than obtained using equations 7, 8, 11 and 12. Further, time-averaged values of $D_{1m}$, $D_{2m}$, $g_{1m}$ and $g_{2m}$ may be taken as intermediate prediction parameters.

Further, the methods for calculating intermediate prediction parameters may use methods other than that described above as far as the method is capable of calculating values in the vicinity of the middle of the delay time difference and amplitude ratio between the first channel and the second channel.

Monaural signal calculating section 203 uses intermediate prediction parameters obtained in intermediate prediction parameter generating section 202 and calculates the monaural signal s_mono(n) using equation 13.

[5]

$$s_\text{mono}(n)=\{g_{1m}\cdot s_ch1(n-D_{1m})+g_{2m}\cdot s_ch2(n-D_{2m})\}/2 \text{ where } n=0 \text{ to } NF-1 \quad \text{(Equation 13)}$$

The monaural signal may be calculated only from the input speech signal of one of channels rather than generating a monaural signal using the input speech signal of both channels as described above.

Figure 3:
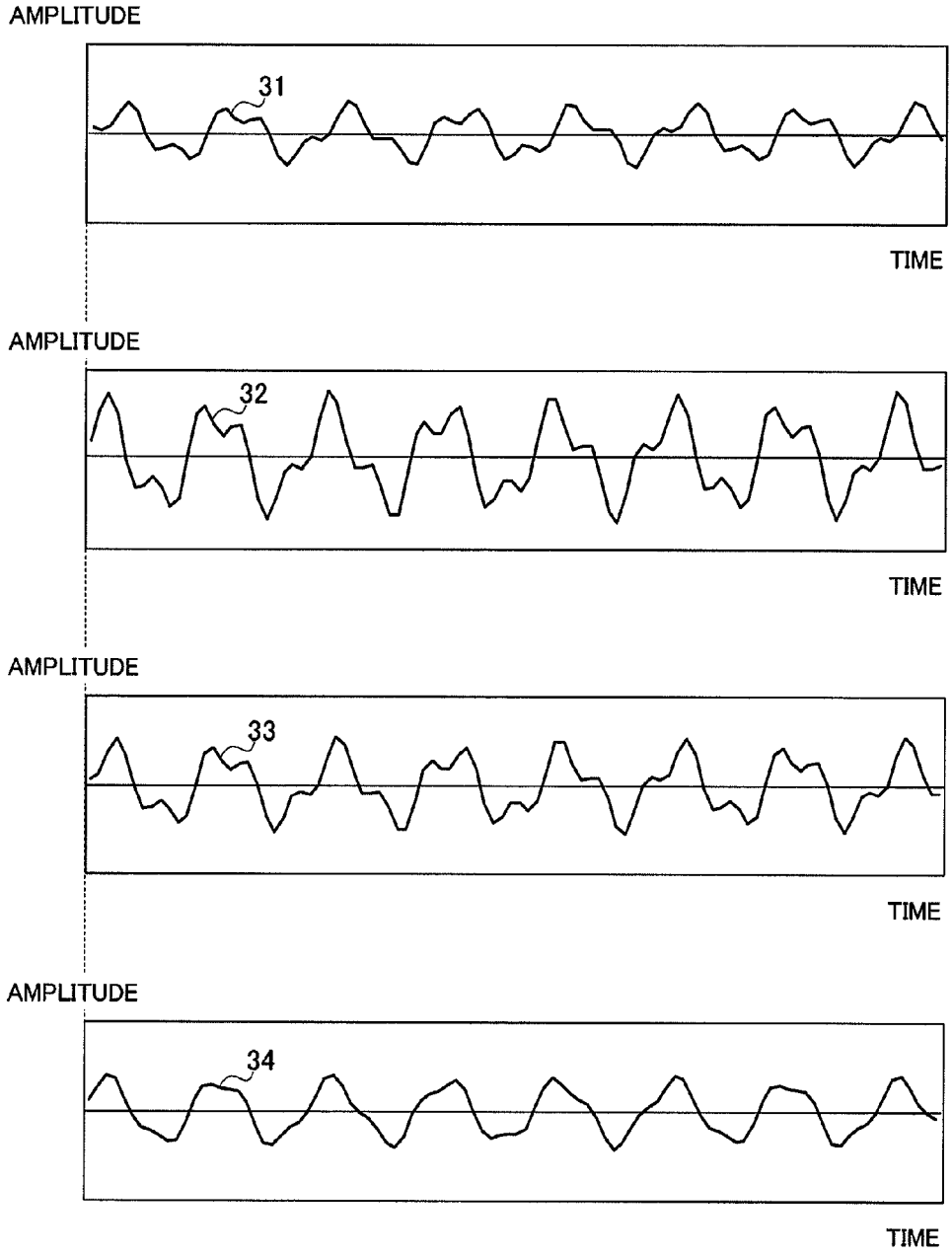
FIG. 3 is a signal waveform diagram according to Embodiment 1 of the present invention.

FIG. 3 shows examples of waveform 31 for the first channel speech signal and waveform 32 for the second channel speech signal inputted to monaural signal generating section 101. In this case, the monaural signal generated from the first channel speech signal and the second channel speech signal by monaural signal generating section 101 is shown as waveform 33. Waveform 34 is a (conventional) monaural signal generated by simply averaging the first channel speech signal and the second channel speech signal.

When the delay time difference and amplitude ratio as shown between the first channel speech signal (waveform 31) and second channel speech signal (waveform 32) exist, monaural signal waveform 33 obtained in monaural signal generating section 101 is similar to both the first channel speech signal and the second channel speech signal, and has an intermediate delay time and amplitude. However, a monaural signal (waveform 34) generated by the conventional method is less similar to the waveforms of the first channel speech signal and second channel speech signal compared with waveform 33. This is because the monaural signal (waveform 33) generated such that the delay time difference and amplitude ratio between both channels become intermediate values between both channels approximately corresponds to signals received at the intermediate point between two spatial points, therefore the generated monaural signal becomes a more appropriate signal as a monaural signal, that is, a signal similar to the input signal with little distortion, compared to the monaural signal (waveform 34) generated without considering spatial characteristics.

Further, the monaural signal (waveform 34) generated by simply averaging signals for both channel signals is a signal generated simply using the average calculation without taking into consideration delay time differences and amplitude ratio between signals of both channels, it naturally follows that, when the delay time difference between the signals of the channels is large, both the channel speech signals become time-shifted and overlapped, and a signal is distorted with respect to the input speech signal or is substantially different from the input speech signal. As a result, this invites a decrease in coding efficiency when encoding the monaural signal using a coding model in accordance with speech signal characteristics such as CELP coding.

In contrast to this, the monaural signal (waveform 33) obtained in monaural signal generating section 101 is adjusted to minimize the delay time difference between speech signals of both channels so that the monaural signal becomes similar to the input speech signal with little distortion. It is therefore possible to suppress a decrease of coding efficiency at the time of monaural signal coding.

Monaural signal generating section 101 may also be as follows.

Namely, other parameters in addition to the delay time difference and amplitude ratio may be used as prediction parameters. For example, when prediction between channels is represented by equations 14 and 15, the delay time difference, amplitude ratio and prediction coefficient sequences $\{a_{kl}(0), a_{kl}(1), a_{kl}(2), \ldots, a_{kl}(P)\}$ (P: an order of prediction, $a_{k1}(0)=1.0$ (k, l)=(1, 2) or (2, 1)) between both channel signals are provided as prediction parameters.

[6]

$$\text{sp_chl}(n)=\sum_{k=0}^{P}\{g_{21}\cdot a_{21}(k)\cdot \text{sp_ch2}(n-D_{21}-k)\} \quad \text{(Equation 14)}$$

$$\text{sp_ch2}(n)=\sum_{k=0}^{P}\{g_{12}\cdot a_{12}(k)\cdot \text{sp_ch1}(n-D_{12}-k)\} \quad \text{(Equation 15)}$$

Further, the first channel speech signal and second channel speech signal may be subjected to band-split into two or more frequency bands for generating input signals by bands, and the monaural signal may be generated, as described above, by performing the same by bands for signals for part or all of bands.

Figure 4:
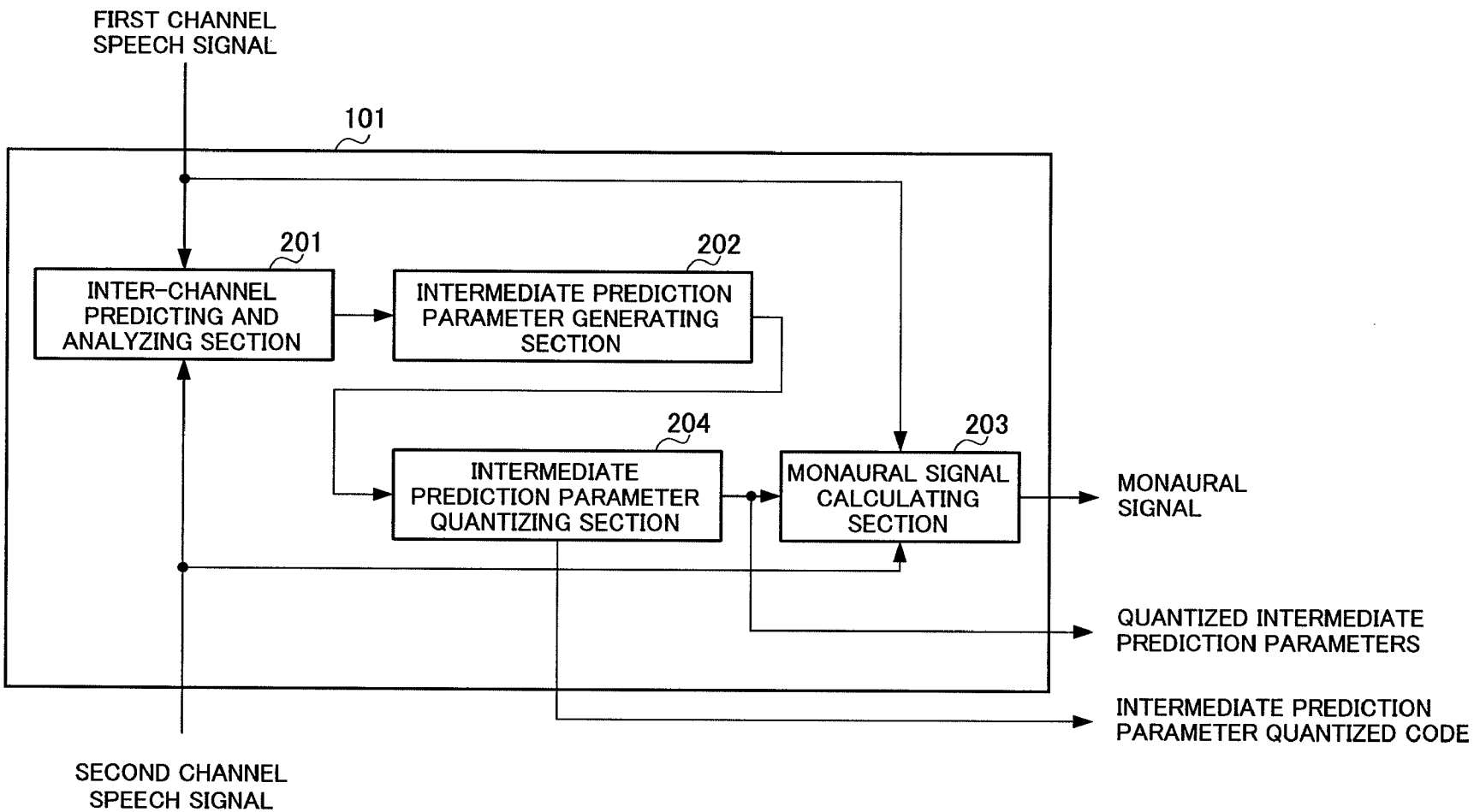
FIG. 4 is a block diagram showing a configuration of a monaural signal generating section according to Embodiment 1 of the present invention.

Further, to transmit intermediate prediction parameters obtained in intermediate prediction parameter generating section 202 together with coded data and reduce the necessary amount of computation for subsequent encoding by using intermediate prediction parameters in subsequent encoding, monaural signal generating section 101 may have intermediate prediction parameter quantizing section 204 that quantizes intermediate prediction parameters and outputs quantized intermediate prediction parameters and intermediate prediction parameter quantized code as shown in FIG. 4.

Embodiment 2

Figure 5:
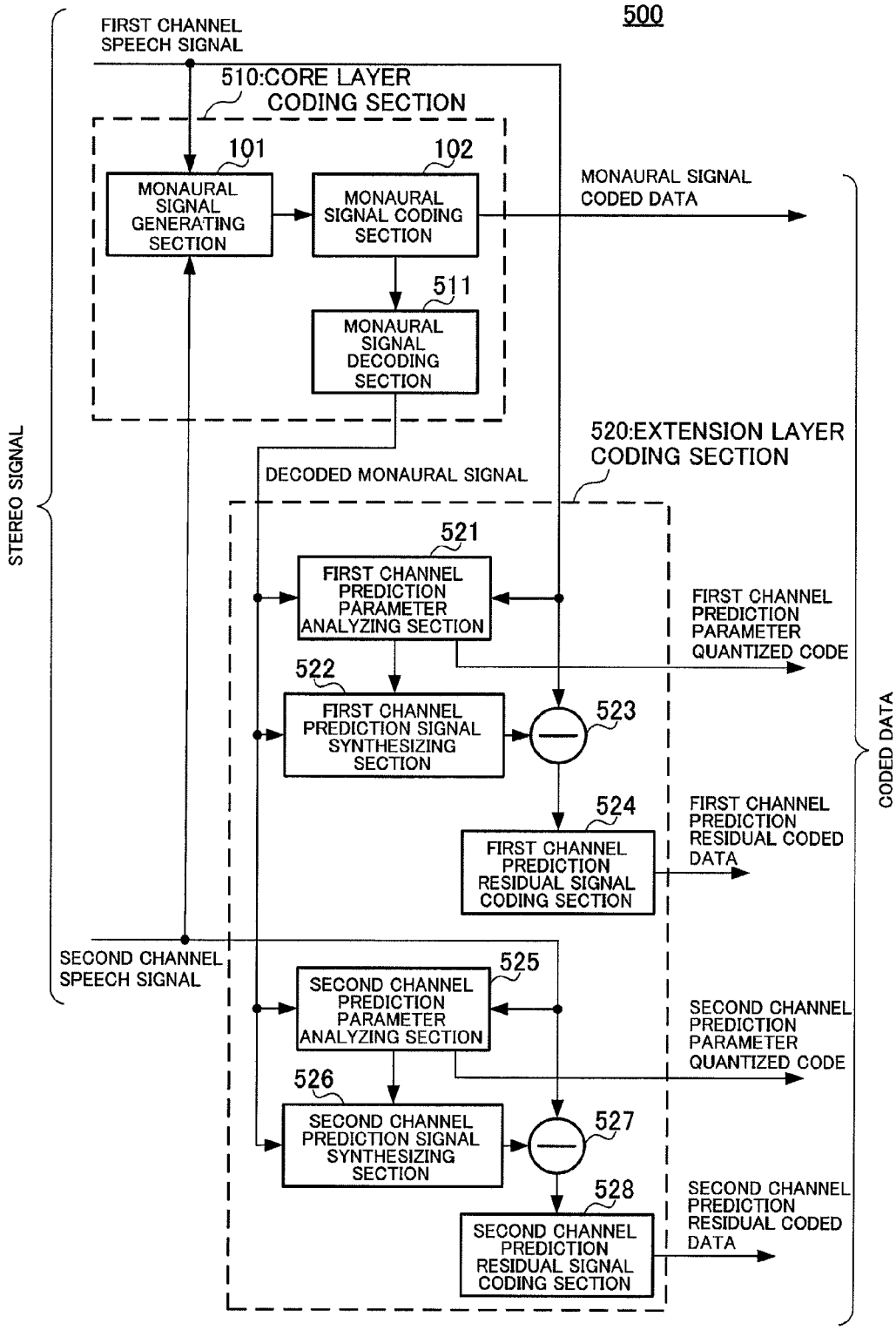
FIG. 5 is a block diagram showing a configuration of a speech coding apparatus according to Embodiment 2 of the present invention.

In the present embodiment, speech encoding employing a monaural-stereo scalable configuration will be described. A configuration of a speech coding apparatus according to the present embodiment is shown in FIG. 5. Speech coding apparatus 500 shown in FIG. 5 has core layer coding section 510 for the monaural signal and extension layer coding section 520 for the stereo signal. Further, core layer coding section 510 has speech coding apparatus 10 (FIG. 1: monaural signal generating section 101 and monaural signal coding section 102) according to Embodiment 1.

In core layer coding section 510, monaural signal generating section 101 generates the monaural signal s_mono(n) as described in Embodiment 1 and outputs the monaural signal s_mono(n) to monaural signal coding section 102.

Monaural signal coding section 102 encodes the monaural signal, and outputs coded data of the monaural signal to monaural signal decoding section 511. Further, the monaural signal coded data is multiplexed with quantized code or coded data outputted from extension layer coding section 520, and transmitted to the speech decoding apparatus as coded data.

Monaural signal decoding section 511 generates and outputs a decoded monaural signal from coded data for the monaural signal to extension layer coding section 520.

In extension layer coding section 520, first prediction parameter analyzing section 521 obtains and quantizes first channel prediction parameters from the first channel speech signal s_ch1(*n*) and the decoded monaural signal, and outputs first channel prediction quantized parameters to first channel prediction signal synthesizing section 522. Further, first channel prediction parameter analyzing section 521 outputs first channel prediction parameter quantized code, which is obtained by encoding the first channel prediction quantized parameters. The first channel prediction parameter quantized code is multiplexed with other coded data or quantized code, and transmitted to a speech decoding apparatus as coded data.

First channel prediction signal synthesizing section 522 synthesizes the first channel prediction signal by using the decoded monaural signal and the first channel prediction quantized parameters and outputs the first channel prediction signal to subtractor 523. First channel prediction signal synthesizing section 522 will be described in detail later.

Subtractor 523 obtains the difference between the first channel speech signal and the first channel prediction signal that are the input signals, that is, a signal for a residual component (first channel prediction residual signal) of the first channel prediction signal with respect to the first channel input speech signal, and outputs the difference to first channel prediction residual signal coding section 524.

First channel prediction residual signal coding section 524 encodes the first channel prediction residual signal and outputs first channel prediction residual coded data. This first channel prediction residual coded data is multiplexed with other coded data or quantized code and transmitted to a speech decoding apparatus as coded data.

On the other hand, second channel prediction parameter analyzing section 525 obtains and quantizes second channel prediction parameters from a second channel speech signal s_ch2(*n*) and the decoded monaural signal, and outputs second channel prediction quantized parameters to second channel prediction signal synthesizing section 526. Further, second channel prediction parameter analyzing section 525 outputs second channel prediction parameter quantized code, which is obtained by encoding the second channel prediction quantized parameters. This second channel prediction parameter quantized code is multiplexed with other coded data or quantized code, and transmitted to a speech decoding apparatus as coded data.

Second channel prediction signal synthesizing section 526 synthesizes the second channel prediction signal by using the decoded monaural signal and the second channel prediction quantized parameters and outputs the second channel prediction signal to subtractor 527. Second channel prediction signal synthesizing section 526 will be described in detail later.

Subtractor 527 obtains and outputs the difference, that is, a signal for a residual component of the second channel prediction signal with respect to the second input speech signal (second channel prediction residual signal), between the second channel speech signal, which is the inputted signal and the second channel prediction signal to second channel prediction residual signal coding section 528.

Second channel prediction residual signal coding section 528 encodes the second channel prediction residual signal and outputs second channel prediction residual coded data. This second channel prediction residual coded data is then multiplexed with other coded data or quantized code, and transmitted to the speech decoding apparatus as coded data.

Figure 6:
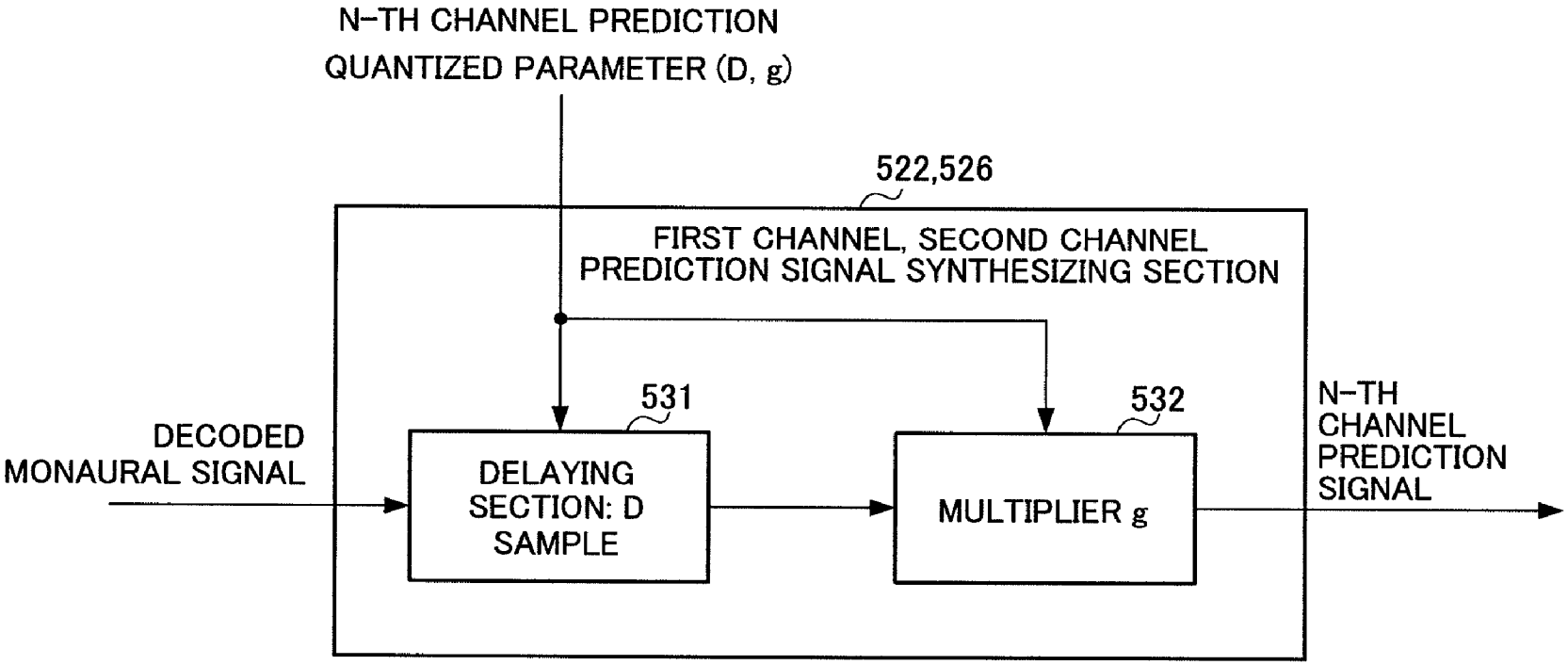
FIG. 6 is a block diagram showing a configuration of the first channel and second channel prediction signal synthesizing sections according to Embodiment 2 of the present invention.

Next, first channel prediction signal synthesizing section 522 and second channel prediction signal synthesizing section 526 will be described in detail. The configurations of first channel prediction signal synthesizing section 522 and second channel prediction signal synthesizing section 526 is as shown in FIG. 6 <configuration example 1> and FIG. 7 <configuration example 2>. In the configuration examples 1 and 2, prediction signals of each channel from the monaural signal are synthesized based on correlation between the monaural signal and channel signals by using the delay differences (D samples) and amplitude ratio (g) of channel signals with respect to the monaural signal as prediction quantized parameters.

<Configuration Example 1>

In configuration example 1, as shown in FIG. 6, first channel prediction signal synthesizing section 522 and second channel prediction signal synthesizing section 526 have delaying section 531 and multiplexer 532, and synthesize prediction signals sp_ch(n) of each channel from a decoded monaural signal sd_mono(n) using prediction represented by equation 16.

[7]

$$sp_ch(n)=g\cdot sd_\mathrm{mono}(n-D) \quad \text{(Equation 16)}$$

<Configuration Example 2>

Figure 7:
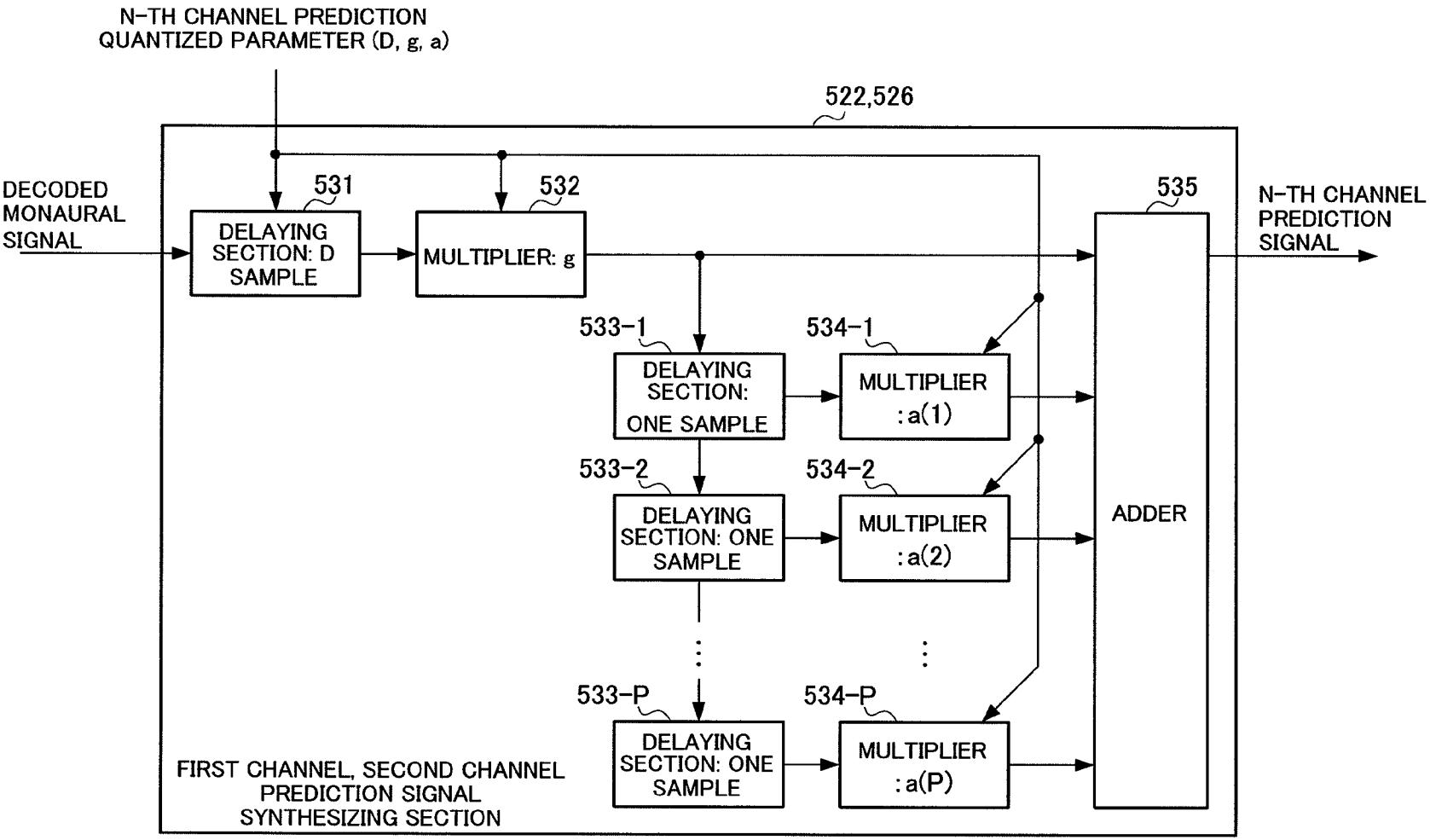
FIG. 7 is a block diagram showing a configuration of first channel and second channel prediction signal synthesizing sections according to Embodiment 2 of the present invention.

Configuration example 2, as shown in FIG. 7, further provides delaying sections 533-1 to P, multiplexers 534-1 to P and adder 535 in the configuration shown in FIG. 6. Prediction signals sp_ch(n) of each channel are synthesized from the decoded monaural signal sd_mono(n) by using prediction coefficient series {a(0), a(1), a(2), . . . , a(P)} (where P is an order of prediction, and a(0)=1.0) in addition to delay difference (D samples) and amplitude ratio (g) of each channel with respect to the monaural signal as prediction quantized parameters and by using prediction represented by equation 17.

[8]

$$\mathrm{sp_ch}(n)=\sum_{k=0}^{P}\{g\cdot a(k)\cdot \mathrm{sd_mono}(n-D-k)\} \quad \text{(Equation 17)}$$

On the other hand, first channel prediction parameter analyzing section 521 and second channel prediction parameter analyzing section 525 obtain prediction parameters that minimize distortions Dist1 and Dist2 represented by equations 3 and 4, and output the prediction quantized parameters obtained by quantizing the prediction parameters, to first channel prediction signal synthesizing section 522 and second channel prediction signal synthesizing section 526 having the above configuration. Further, first channel prediction parameter analyzing section 521 and second channel prediction parameter analyzing section 525 output prediction parameter quantized code obtained by encoding the prediction quantized parameters.

In configuration example 1, first channel prediction parameter analyzing section 521 and second channel prediction parameter analyzing section 525 may obtain the delay difference D and a ratio g for average amplitude in frame units that maximize cross-correlation between the decoded monaural signal and the input speech signal of each channel.

Figure 8:
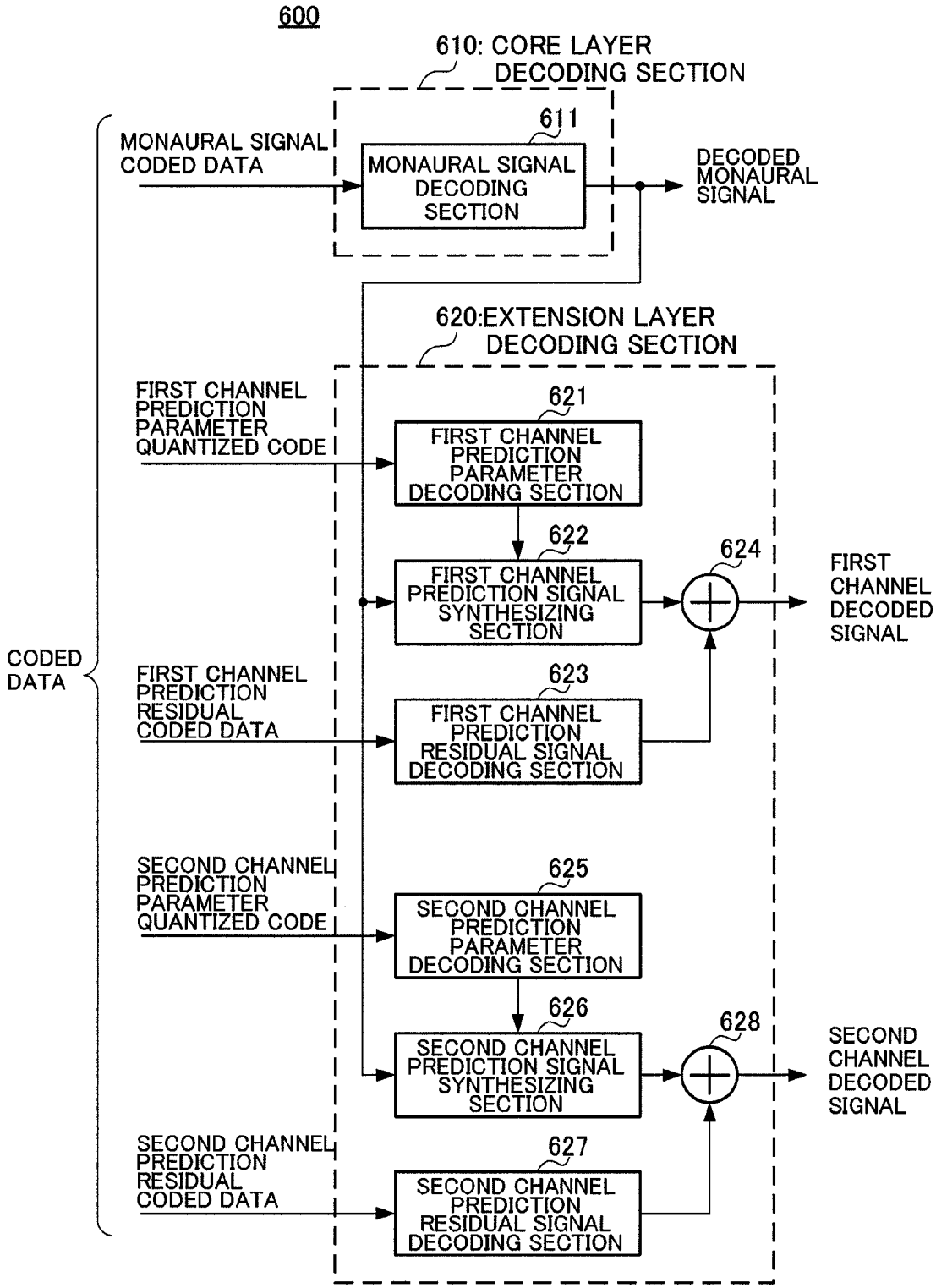
FIG. 8 is a block diagram showing a configuration of a speech decoding apparatus according to Embodiment 2 of the present invention.

Next, a speech decoding apparatus according to the present embodiment will be described. A configuration of the speech decoding apparatus according to the present embodiment is shown in FIG. 8. Speech decoding apparatus 600 shown in FIG. 8 has core layer decoding section 610 for the monaural signal and extension layer decoding section 620 for the stereo signal.

Monaural signal decoding section 611 decodes coded data for the inputted monaural signal, outputs the decoded monaural signal to extension layer decoding section 620 and outputs the decoded monaural signal as the actual output.

First channel prediction parameter decoding section 621 decodes inputted first channel prediction parameter quantized code and outputs first channel prediction quantized parameters to first channel prediction signal synthesizing section 622.

First channel prediction signal synthesizing section 622 employs the same configuration as first channel prediction signal synthesizing section 522 of speech coding apparatus 500, predicts a first channel speech signal from the decoded monaural signal and first channel prediction quantized parameters and outputs the first channel prediction speech signal to adder 624.

First channel prediction residual signal decoding section 623 decodes inputted first channel prediction residual coded data and outputs a first channel prediction residual signal to adder 624.

Adder 624 adds the first channel prediction speech signal and the first channel prediction residual signal, and obtains and outputs the first channel decoded signal as actual output.

On the other hand, second channel prediction parameter decoding section 625 decodes inputted second channel prediction parameter quantized code and outputs second channel prediction quantized parameters to second channel prediction signal synthesizing section 626.

Second channel prediction signal synthesizing section 626 employs the same configuration as second channel prediction signal synthesizing section 526 of speech coding apparatus 500, predicts a second channel speech signal from the decoded monaural signal and second channel prediction quantized parameters and outputs the second channel prediction speech signal to adder 628.

Second channel prediction residual signal decoding section 627 decodes inputted second channel prediction residual coded data and outputs a second channel prediction residual signal to adder 628.

Adder 628 adds the second channel prediction speech signal and the second channel prediction residual signal, and obtains and outputs a second channel decoded signal as actual output.

Speech decoding apparatus 600 employing above configuration, in a monaural-stereo scalable configuration, when output speech is monaural, outputs a decoded signal obtained from only coded data for a monaural signal as a decoded monaural signal, and when output speech is stereo, decodes and outputs the first channel decoded signal and the second channel decoded signal using all of the received coded data and quantized codes.

In this way, the present embodiment synthesizes the first channel prediction signal and the second channel prediction signal using a decoded monaural signal that is obtained by decoding a monaural signal that is similar to the first channel speech signal and second channel speech signal and that has an intermediate delay time and amplitude, so that it is possible to improve prediction performance for these prediction signals.

CELP coding may be used in the core layer encoding and the extension layer encoding. In this case, at the extension layer, LPC prediction residual signals of signals of each channel are predicted using a monaural coding excitation signal obtained by CELP coding.

Further, when using CELP coding in the core layer encoding and the extension layer encoding, the excitation signal may be encoded in the frequency domain rather than performing excitation search in the time domain.

Further, each channel signal or LPC prediction residual signal of each channel signal may be predicted using intermediate prediction parameters obtained in monaural signal generating section 101 and the decoded monaural signal or the monaural excitation signal obtained by CELP-coding for the monaural signal.

Further, only either one channel signal of the stereo input signals may be subjected to encoding using prediction as described above from the monaural signal. In this case, the speech decoding apparatus can generate the decoded signal of one channel from the decoded monaural signal and another channel signal based on the relationship between the stereo input signal and the monaural signal (for example, equation 12).

Embodiment 3

Figure 9:
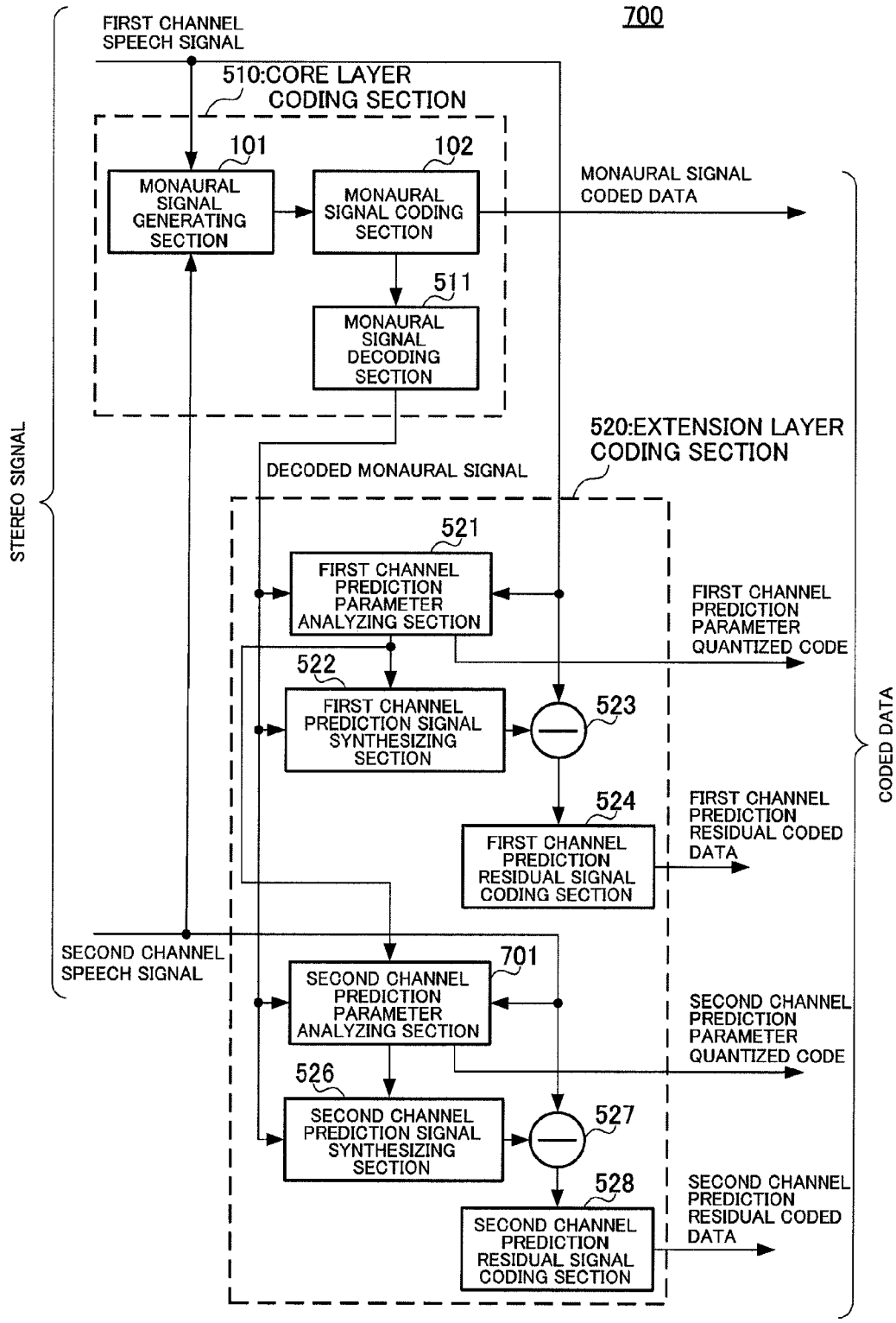
FIG. 9 is a block diagram showing a configuration of a speech coding apparatus according to Embodiment 3 of the present invention.

The speech coding apparatus according to the present embodiment uses delay time differences and amplitude ratio between a monaural signal and signals of each channel as prediction parameters, and quantizes second channel prediction parameters using first channel prediction parameters. A configuration of speech coding apparatus 700 according to the present embodiment is shown in FIG. 9. In FIG. 9, the same components as in Embodiment 2 (FIG. 5) are allotted the same reference numerals and are not described.

In quantization of the second channel prediction parameters, second channel prediction parameter analyzing section 701 estimates second channel prediction parameters from the first channel prediction parameters obtained in first channel prediction parameter analyzing section 521 based on correlation (dependency relationship) between the first channel prediction parameters and the second channel prediction parameters and efficiently quantize the second channel prediction parameters. To be more specific, this is as follows.

Dq1 and gq1 represents first channel prediction quantized parameters (delay time difference, amplitude ratio) obtained in first channel prediction parameter analyzing section 521, and D2 and g2 represents second channel prediction parameters (before quantization) obtained by analysis. The monaural signal is generated as an intermediate signal of the first channel speech signal and the second channel speech signal as described above and correlation between the first channel prediction parameters and the second channel prediction parameters is high. The second channel prediction parameters Dp2 and gp2 are estimated from equation 18 and equation 19 using the first channel prediction quantized parameters.

[9]

$$Dp2=-Dq1 \quad \text{(Equation 18)}$$

$$gp2=1/gq1 \quad \text{(Equation 19)}$$

Quantization of the second channel prediction parameters is performed with respect to estimation residuals (differential value with estimation value) δD2 and δg2 represented by equation 20 and equation 21. These estimation residuals have smaller distribution than the second channel prediction parameters and it is possible to perform more efficient quantization.

[10]

$$\delta D2=D2-Dp2 \quad \text{(Equation 20)}$$

$$\delta g2=g2-gp2 \quad \text{(Equation 21)}$$

Equations 18 and 19 are examples, and the second channel prediction parameters may be estimated and quantized using another method utilizing correlation (dependency relationship) between the first channel prediction parameters and the second channel prediction parameters. Further, a codebook for a set of first channel prediction parameters and second channel prediction parameters may be provided and subjected to quantization using vector quantization. Moreover, the first channel prediction parameters and second channel prediction parameters may be analyzed and quantized using the intermediate prediction parameters obtained from the configurations of FIG. 2 or FIG. 4. In this case, the first channel prediction parameters and the second channel prediction parameters can be estimated in advance so that it is possible to reduce the amount of calculation required for analysis.

The configuration of the speech decoding apparatus according to the present embodiment is substantially the same as Embodiment 2 (FIG. 8). However, one difference is that second channel prediction parameter decoding section 625 performs the decoding processing corresponding to the configuration of speech coding apparatus 700 using, for example, first channel prediction quantized parameters when decoding the second channel prediction quantized code.

Embodiment 4

Figure 10:
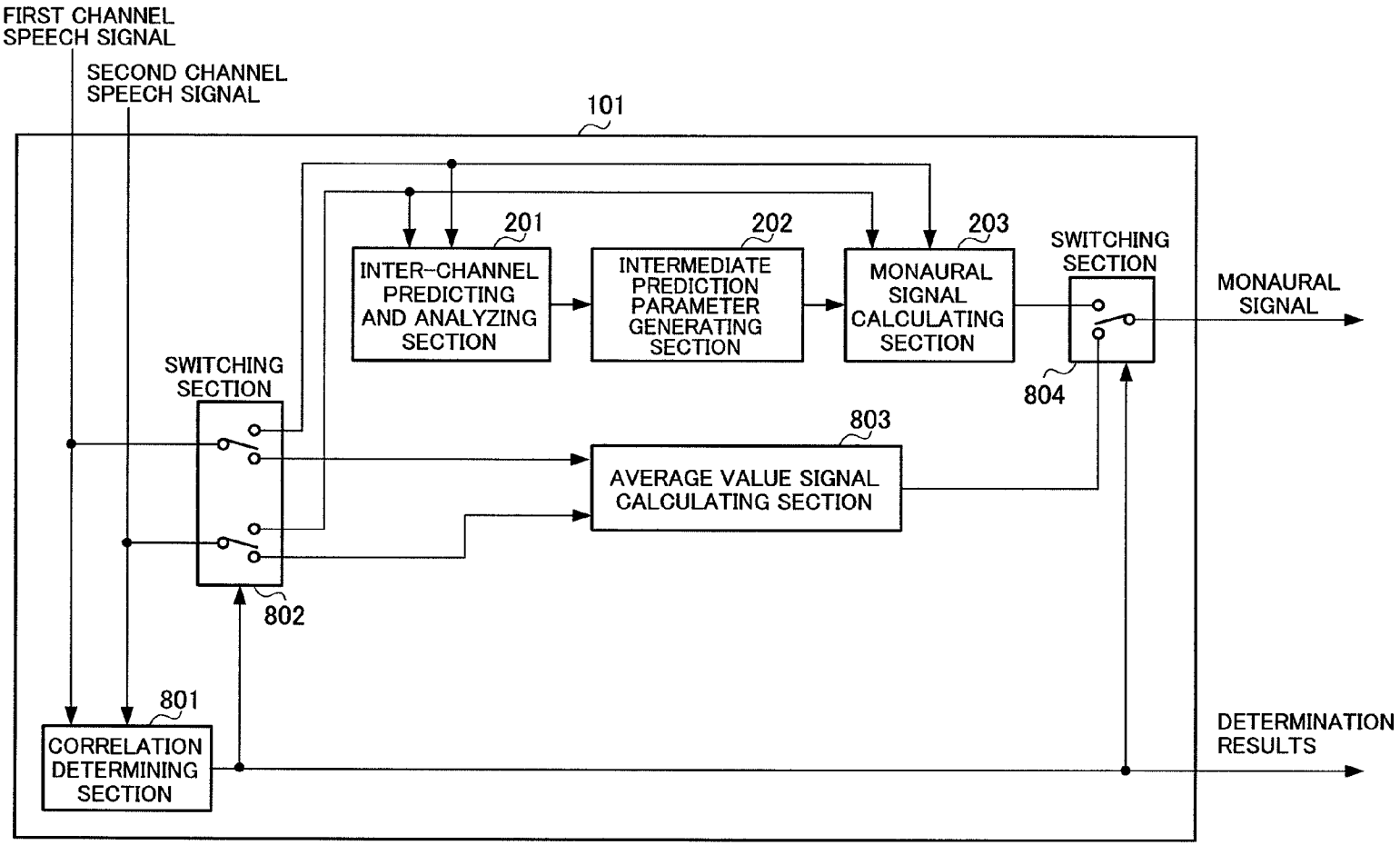
FIG. 10 is a block diagram showing a configuration of a monaural signal generating section according to Embodiment 4 of the present invention.

When correlation between the first channel speech signal and the second channel speech signal is low, cases occur where an intermediate signals is generated in an insufficient manner in terms of spatial characteristics despite the monaural signal generation described in embodiment 1. Therefore the speech coding apparatus according to the present embodiment switches monaural signal generation method based on correlation between the first channel and the second channel. The configuration of monaural signal generating section 101 according to the present embodiment is shown in FIG. 10. In FIG. 10, the same components as Embodiment 1 (FIG. 2) are allotted the same reference numerals and are not described.

Correlation determining section 801 calculates correlation between the first channel speech signal and the second channel speech signal and determines whether or not this correlation is higher than a threshold value. Correlation determining section 801 controls switching sections 802 and 804 based on the determination result. Calculation of correlation and judgment based on the threshold are performed by, for example, obtaining a maximum value (normalization value) of a cross-correlation function between signals of each channel and comparing the maximum value with predetermined threshold values.

When correlation is higher than a threshold value, correlation determining section 801 switches switching section 802 so that a first channel speech signal and a second channel speech signal are inputted to inter-channel predicting and analyzing section 201 and monaural signal calculating section 203, and switches switching section 804 to the side of monaural signal calculating section 203. As a result, when correlation between the first channel and the second channel is higher than a threshold value, a monaural signal is generated as described in Embodiment 1.

On the other hand, when correlation is equal to or less than the threshold value, correlation determining section 801 switches switching section 802 so that the first channel speech signal and the second channel speech signal are inputted to average value signal calculating section 803, and switches switching section 804 to the side of average value signal calculating section 803. In this case, average value signal calculating section 803 calculates the average value signal s_av(n) of the first channel speech signal and the second channel speech signal using equation 22 and outputs the average value signal s_av(n) as a monaural signal.

[11]

$$s_av(n)=(s_ch1(n)+s_ch2(n))/2 \text{ where } n=0 \text{ to } NF\text{-}1 \quad \text{(Equation 22)}$$

When correlation between the first channel speech signal and the second channel speech signal is low, the present embodiment provides the signal as a monaural signal which is the average value of the first channel speech signal and second channel speech signal so that it is possible to prevent sound quality from deteriorating in the case where correlation between the first channel speech signal and the second channel speech signal is low. Further, encoding is performed using an appropriate encoding mode based on correlation between the two channels so that it is also possible to improve coding efficiency.

The monaural signals generated by switching generating methods based on correlation between the first channel and second channel as described above may be subjected to scalable coding according to correlation between the first channel and second channel. When correlation between the first channel and second channel is higher than the threshold value, monaural signals are encoded at the core layer and encoding is performed utilizing signal prediction of each channel signal by using decoded monaural signals at extension layers using the configuration shown in Embodiments 2 and 3. On the other hand, when correlation between the first channel and the second channel is equal to or less than the threshold value, the monaural signal is encoded at the core layer and then encoding is performed using other scalable configuration appropriate when correlation between the two channels is low. Encoding using other scalable configuration appropriate when correlation is low includes a method for, for example, not using inter-channel prediction and directly encoding difference signals of each channel signal and the decoded monaural signal. Further, when CELP coding is applied to core layer coding and extension layer coding, extension layer coding employs, for example, a method of not using inter-channel prediction and directly encoding a monaural excitation signal.

Embodiment 5

Figure 11:
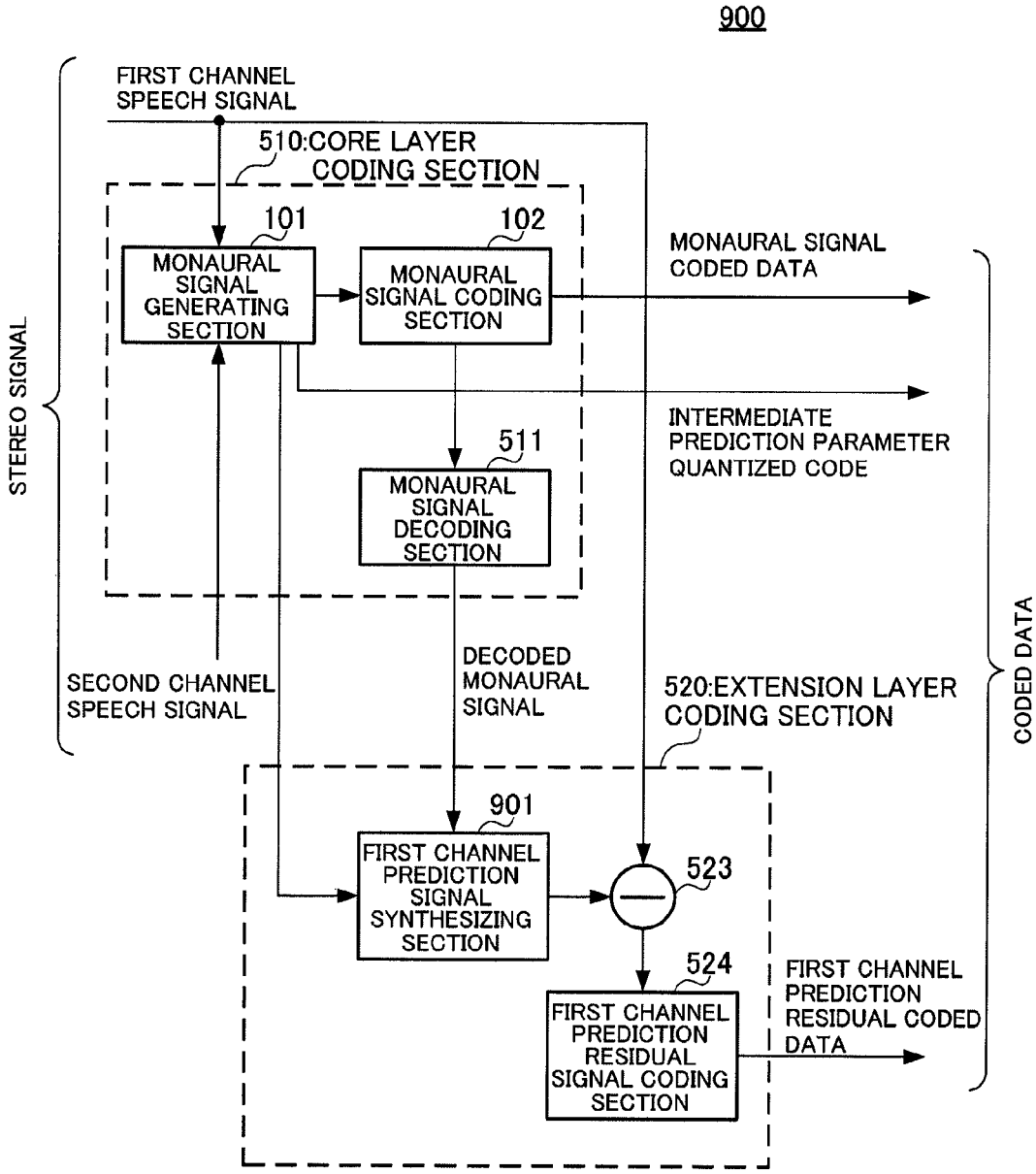
FIG. 11 is a block diagram showing a configuration of a speech coding apparatus according to Embodiment 5 of the present invention.

The speech coding apparatus according to the present embodiment encodes the first channel alone at the extension layer coding section and synthesizes the first channel prediction signal using the quantized intermediate prediction parameter in this encoding. A configuration of speech coding apparatus 900 according to the present embodiment is shown in FIG. 11. In FIG. 11, the same components as Embodiment 2 (FIG. 5) are allotted the same reference numerals and are not described.

In the present embodiment, monaural signal generating section 101 employs the configuration shown in FIG. 4. Namely, monaural signal generating section 101 has intermediate prediction parameter quantizing section 204, and intermediate prediction parameter quantizing section 204 quantizes the intermediate prediction parameters and outputs the quantized intermediate prediction parameters and intermediate prediction parameter quantized code. The quantized intermediate prediction parameters include quantized versions of above $D_{1m}$, $D_{2m}$, $g_{1m}$ and $g_{2m}$. The quantized intermediate prediction parameters are inputted to first channel prediction signal synthesizing section 901 of extension layer coding section 520. Further, intermediate prediction parameter quantized code is multiplexed with monaural signal coded data and first channel prediction residual coded data, and transmitted to the speech decoding apparatus as coded data.

In extension layer coding section 520, first channel prediction signal synthesizing section 901 synthesizes the first channel prediction signal from the decoded monaural signal and the quantized intermediate prediction parameters, and outputs the first channel prediction signal to subtractor 523. To be more specific, first channel prediction signal synthesizing section 901 synthesizes the first channel prediction signal sp_ch1($n$) from the decoded monaural signal sd_mono (n) using prediction based on equation 23.

[12]

$$sp_ch1(n)=(1/g_{1m})\cdot sd_\mathrm{mono}(n+D_{1m}) \text{ where } n=0 \text{ to } NF\text{-}1 \quad \text{(Equation 23)}$$

Figure 12:
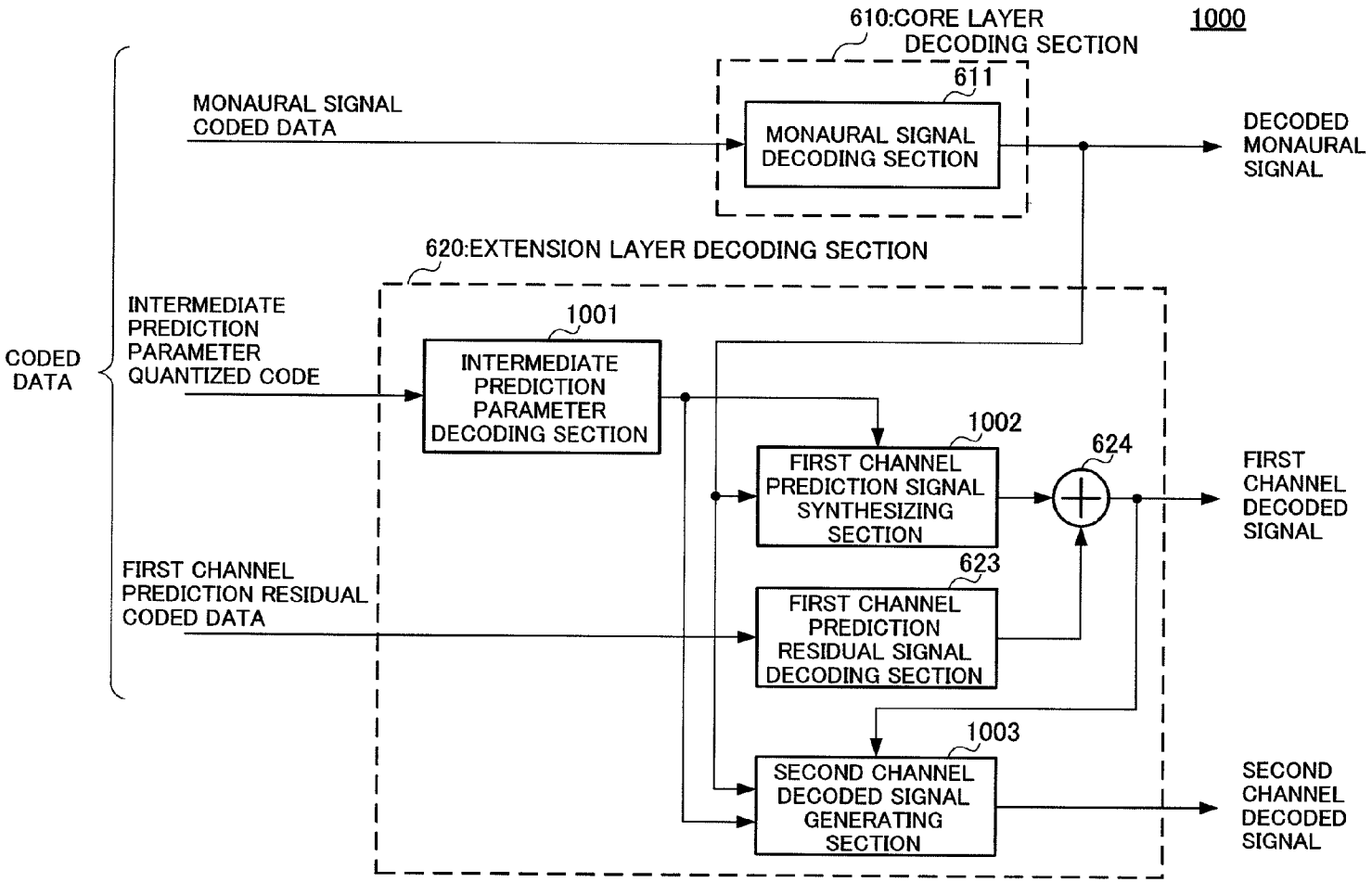
FIG. 12 is a block diagram showing a configuration of a speech decoding apparatus of the Embodiment 5 of the present invention.

Next, the speech decoding apparatus according to the present embodiment will be described. A configuration for speech decoding apparatus 1000 according to the present embodiment is shown in FIG. 12. In FIG. 12, the same components as Embodiment 2 (FIG. 8) are allotted the same reference numerals and are not described.

In extension layer decoding section 620, intermediate prediction parameter decoding section 1001 decodes the inputted intermediate prediction parameter quantized code and outputs quantized intermediate prediction parameters to first channel prediction signal synthesizing section 1002 and second channel decoded signal generating section 1003.

First channel prediction signal synthesizing section 1002 predicts a first channel speech signal from the decoded monaural signal and the quantized intermediate prediction parameters, and outputs the first channel prediction speech signal to adder 624. To be more specific, first channel prediction signal synthesizing section 1002 as first channel prediction signal synthesizing section 901 of speech coding apparatus 900 synthesizes the first channel prediction signal sp_ch1($n$) from the decoded monaural signal sd_mono (n) using prediction represented by equation 23.

On the other hand, second channel decoded signal generating section 1003 receives input of the decoded monaural signal and first channel decoded signal. Second channel decoded signal generating section 1003 generates the second channel decoded signal from the quantized intermediate prediction parameters, decoded monaural signal and first channel decoded signal. To be more specific, second channel decoded signal generating section 1003 generates the second channel decoded signal in accordance with equation 24 obtained from the relationship of above equation 13. In equation 24, sd_ch1 represents first channel decoded signal.

[13]

$$sd_ch2(n)=1/g_{2m}\cdot\{2\cdot sd_\mathrm{mono}(n+D_{2m})-g_{1m}\cdot sd_ch1(n-D_{1m}+D_{2m})\} \text{ where } n=0 \text{ to } NF\text{-}1 \quad \text{(Equation 24)}$$

Although a configuration has been described with the above descriptions where the first channel prediction signal alone is synthesized in extension layer coding section 520, a configuration for synthesizing the second channel prediction signal alone in place of the first channel, is also possible. Namely, the present embodiment employs a configuration of encoding only one channel of the stereo signal in extension layer coding section 520.

In this way, the present embodiment employs a configuration where only one channel of the stereo signal is encoded at extension layer coding section 520 and where prediction parameters used in the synthesis of the one channel prediction signal is used in common with intermediate prediction parameters for monaural signal generation, so that it is possible to improve coding efficiency. Further, the configuration employed in extension layer coding section 520 encodes only one channel of the stereo signals so that it is possible to improve coding efficiency and achieve a lower bit rate of the extension layer coding section compared to the configuration of encoding both channels.

The present embodiment may calculate parameters common to both channels as intermediate prediction parameters obtained in monaural signal generating section 101 rather than calculating different parameters based on the first channel and second channel described above. For example, quantized code for parameters $D_m$ and $g_m$ calculated using equations 25 and 26 may be transmitted to speech decoding apparatus 1000 as coded data, and $D_{1m}$, $g_{1m}$, $D_{2m}$ and $g_{2m}$ calculated from parameters $D_m$ and $g_m$ in accordance with equation 27 to 30 may be used as intermediate prediction parameters based on the first channel and second channel. Thus, it is possible to improve coding efficiency of intermediate prediction parameters transmitted to speech decoding apparatus 1000.

[14]

$$D_m=\{(D_{12}-D_{21})/2\}/2 \quad \text{(Equation 25)}$$

$$g_m=\sqrt{\{g_{12}\cdot(1/g_{21})\}} \quad \text{(Equation 26)}$$

$$D_{1m}=D_m \quad \text{(Equation 27)}$$

$$D_{2m}=-D_m \quad \text{(Equation 28)}$$

$$g_{1m}=g_m \quad \text{(Equation 29)}$$

$$g_{2m}=1/g_m \quad \text{(Equation 30)}$$

Further, a plurality of candidates for intermediate prediction parameters may be provided, and intermediate prediction parameters out of the plurality of candidates that minimize coding distortion (distortion of extension layer coding section 520 alone, or the total sum of distortion of the core layer coding section 510 and distortion of the extension layer coding section 520) after encoding in extension layer coding section 520 may be used in encoding in extension layer coding section 520. By this means, it is possible to select optimum parameters that improve prediction performance upon synthesis of prediction signals at the extension layer and improve sound quality. The specific step is as follows.

<Step 1: Monaural Signal Generation>

In monaural signal generating section 101, a plurality of intermediate prediction parameter candidates are outputted and monaural signals generated corresponding to each candidate are outputted. For example, a predetermined number of intermediate prediction parameters in order from the smallest prediction distortion or the highest cross-correlation between signals of each channel may be outputted as a plurality of candidates.

<Step 2: Monaural Signal Coding>

In monaural signal coding section 102, monaural signals are encoded using monaural signals generated corresponding to the plurality of intermediate prediction parameter candidates, and monaural signal coded data and coding distortion (monaural signal coding distortion) are outputted per plurality of candidates.

<Step 3: First Channel Coding>

In extension layer coding section 520, a plurality of first channel prediction signals are synthesized using a plurality of intermediate prediction parameter candidates, the first channel is encoded and coded data (first channel prediction residual coded data) and coding distortion (stereo coding distortion) are outputted per plurality of candidates.

<Step 4: Minimum Coding Distortion Selection>

In extension layer coding section 520, intermediate prediction parameters out of the plurality of intermediate prediction parameters candidates that minimize the total sum of coding distortion obtained in step 2 and step 3 (or one of the total sum of coding distortion obtained in step 2 and the total sum of coding distortion obtained in step 3) are determined as parameters used in encoding, and monaural signal coded data corresponding to the intermediate prediction parameters, intermediate prediction parameter quantized code and first channel prediction residual coded data are transmitted to speech decoding apparatus 1000.

One of the plurality of intermediate prediction parameters candidates may include the case where $D_{1m}=D_{2m}=0$ and $g_{1m}=g_{2m}=1.0$ (corresponding to normal monaural signal generation). When this candidate is used in encoding, encoding may be performed in core layer coding section 510 and extension layer coding section 520 by allocating encoding bits on the condition that intermediate prediction parameters are not transmitted (only selection information (one bit) is transmitted as a selection flag for a normal monaural mode). Thus, it is possible to implement optimum encoding based on a coding distortion minimization including normal monaural mode as a candidate and eliminate the necessity to transmit intermediate prediction parameters at the time of selecting the normal monaural mode so that it is possible to allocates bits to other coded data and improve sound quality.

Further, the present embodiment may use CELP coding for encoding the core layer and encoding the extension layer. In this case, at the extension layer, LPC prediction residual signals of signals of each channel are predicted using a monaural coding excitation signal obtained by CELP coding.

Further, when using CELP coding for encoding the core layer and the extension layer, the excitation signal may be encoded in the frequency domain rather than excitation search in the time domain.

The speech coding apparatus and speech decoding apparatus of above embodiments can also be mounted on radio communication apparatus such as wireless communication mobile station apparatus and radio communication base station apparatus used in mobile communication systems.

Also, in the above embodiments, a case has been described as an example where the present invention is configured by hardware. However, the present invention can also be realized by software.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC", system LSI", "super LSI", or "ultra LSI" depending on differing extents of integration.

Further, the method of circuit integration is not limited to LSI'S, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

This specification is based on Japanese patent application No. 2004-380980, filed on Dec. 28, 2004, and Japanese patent application No. 2005-157808, filed on May 30, 2005, the entire content of which is expressly incorporated by reference herein.

INDUSTRIAL APPLICABILITY

The present invention is applicable to uses in the communication apparatus of mobile communication systems and packet communication systems employing internet protocol.

The invention claimed is:

1. A speech coding apparatus comprising:

a first generating section that takes a stereo signal including a first channel signal and a second channel signal as an input signal and generates a monaural signal from the first channel signal and the second channel signal based on a time difference between the first channel signal and the second channel signal and an amplitude ratio of the first channel signal and the second channel signal; and an coding section that encodes the monaural signal.

2. The speech coding apparatus according to claim 1, further comprising:

a second generating section that takes the stereo signal as the input signal, averages the first channel signal and the second channel signal and generates the monaural signal; and a switching section that switches an input destination of the stereo signal between the first generating section and the second generating section according to a degree of correlation between the first channel signal and the second channel signal.

3. The speech coding apparatus according to claim 1, further comprising a synthesizing section that synthesizes prediction signals of the first channel signal and the second channel signal based on a signal obtained from the monaural signal.

4. The speech coding apparatus according to claim 3, wherein the synthesizing section synthesizes the prediction signal using the delay difference and amplitude ratio of the first channel signal or the second channel signal with respect to the monaural signal.

5. The speech coding apparatus according to claim 1, further comprising a synthesizing section that synthesizes a prediction signal of one of the first channel signal and the second channel signal using a parameter for generating the monaural signal.

6. A wireless communication mobile station apparatus comprising the speech coding apparatus according to claim 1.

7. A wireless communication base station apparatus comprising the speech coding apparatus according to claim 1.

8. A speech coding method comprising:

a first generating step of taking a stereo signal including a first channel signal and a second channel signal as an input signal and generating a monaural signal from the first channel signal and the second channel signal based on a time difference between the first channel signal and the second channel signal and amplitude ratio of the first channel signal and the second channel signal; and a coding step of encoding the monaural signal.

* * * * *